United States Patent [19]

Arkema

[11] Patent Number: 4,708,135

[45] Date of Patent: Nov. 24, 1987

[54] SNORKEL

[76] Inventor: Jan Arkema, 1755 Pharmacy Avenue, Agincourt, Ontario, Canada, M1T 1H4

[21] Appl. No.: 685,870

[22] Filed: Dec. 24, 1984

[51] Int. Cl.[4] ..... A62B 7/00

[52] U.S. Cl. ..... 128/201.11

[58] Field of Search ..... 128/200.25, 200.23, 128/200.29, 201.11, 201.19

[56] References Cited

U.S. PATENT DOCUMENTS

| | | | |
|---|---|---|---|
| 859,786 | 7/1907 | Steenerson | 128/201.11 |
| 2,317,236 | 4/1943 | Wilen et al. | 128/201.11 |
| 2,362,775 | 11/1944 | Sebouh | 128/201.11 |
| 2,814,292 | 11/1957 | Girden | 128/201.11 |
| 3,860,042 | 1/1975 | Green | 128/201.11 |
| 4,066,077 | 1/1978 | Shamlian | 128/201.11 |
| 4,071,024 | 1/1978 | Blanc | 128/201.11 |
| 4,278,080 | 7/1981 | Schuch | 128/201.11 |
| 4,380,232 | 4/1983 | Doyle | 128/201.11 |

FOREIGN PATENT DOCUMENTS

| | | | |
|---|---|---|---|
| 868058 | 7/1949 | Fed. Rep. of Germany . | |
| 0420844 | 5/1947 | Italy | 128/201.11 |

*Primary Examiner*—William E. Kamm
*Assistant Examiner*—Angela D. Sykes
*Attorney, Agent, or Firm*—Rogers, Bereskin & Parr

[57] ABSTRACT

A snorkel, for use by a swimmer, includes a mouthpiece and a breathing tube connected to the mouthpiece to enable the swimmer to breathe while submerged. A resilient container is connected to a lowermost portion of the tube, so as to collect any fluid entering the snorkel, to prevent the fluid being entrained in inhaled air. The container can be emptied by manually collapsing it to expel the contents into the breathing tube. The swimmer then exhales to force the fluid out of the breathing tube.

13 Claims, 3 Drawing Figures

SNORKEL

BACKGROUND OF THE INVENTION

This invention relates to a snorkel for use by a swimmer.

The basic principal of a snorkel for a swimmer has been known for a long time. A snorkel has a mouthpiece and a tube which extends upwards from the mouthpiece in use. It enables a swimmer to swim submerged for extended periods of time. A wide variety of different snorkel designs have been proposed. In particular, many of these designs address the problem of unwanted water entry into the snorkel. However, at the present time, there is no satisfactory solution to the problem of unwanted water entry. Indeed, the most common type of snorkel design simply ignores this problem, and has a plain upright tube, into which water can enter. The user or swimmer then has the problem of discharging or eliminating water as it enters the snorkel tube.

An early proposal of a swimming mask, including a snorkel-type tube is to be found in U.S. Pat. No. 859,787 (Steenerson). The overall construction is quite complex. It includes a swimming mask that is intended to form a sealing fit with a person's head, and two valves. To the applicant's knowledge, this somewhat complex and cumbersome design has never been in commercial usage.

A breathing apparatus for swimmers is disclosed in the Wilen U.S. Pat. No. 2,317,236. Of interest is the provision of a check valve at the top of the snorkel tube. It essentially comprises a lightweight ball, which will float on water, and a cage retaining the ball. In use, if water approaches the top of the snorkel tube, the intention is that the ball will be pressed upwards against the seat, to prevent unwanted water entry. However, whilst this type of check valve construction has been employed in many snorkels, it has been found to have numerous disadvantages. In the context of a simple snorkel, it is relatively complex, and can be damaged. Further, the check valve does not always seal reliably, when required. It is quite easy for small quantities of water to enter the snorkel tube. This is particuarly the case, when swimming in water with small, choppy waves. If the ball does rise to close off the tube, when the swimmer is attempting to inhale, then the partial vacuum created by inhalation will hold the ball in place, even if the water then falls away from the ball. Consequently, it requires a conscious effort on the swimmer's part to release this pressure, before commencing inhalation. At best, this is extremely inconvenient. Here, it is effectively acknowledged that the check valve will not prevent entry of water into the snorkel tube. The snorkel construction disclosed also includes a flap-type valve at its lower end. It is stated that this valve is to enable any saliva, or water shipped accidentally, to be purged from the snorkel. The valve is opened, either by the swimmer manually closing the check valve at the top to enable sufficient pressure to be built up, or by the swimmer raising the flap-valve out of the water. The swimmer can then blow out any accumulated saliva, water etc. This procedure is complex and inconvenient.

In U.S. Pat. No. 4,066,077 (Shamlian), there is disclosed a snorkel construction. This patent is primarily concerned with the construction of the mouthpiece, but it dislcoses a simple snorkel construction, which is currently quite popular.

Another snorkel construction is disclosed in U.S. Pat. No. 4,071,024 (Blanc). This construction is quite complex. It also addresses the problem of unwanted water entry. For this purpose, separate inhalation and exhalation tubes are provided. Additionally, a spiral vein is provided around the top of the intake or inhalation tube, to at least retard entry of water. The exhalation tube is shorter and is provided with a one-way flap at its other end. To purge water from the snorkel, a portion of the inhalation tube has to be manually collapsed, so that water can be blown out of the exhalation tube.

A somewhat unusual design of diving snorkel is disclosed in the Schuch U.S. Pat. No. 4,278,080. Here, a purge valve is located in a branch or by-pass conduit. This valves enables water in the snorkel to automatically fall to the level of the surrounding water surface. It is suggested that this minimizes the amount of water required to be purged from the snorkel. This suffers from the disadvantage of requiring a valve, which opens in to the water, and which might leak. Again, as with other designs, one has the problem of actually purging the water from the snorkel, which can be difficult for small quantities of water.

In German Pat. No. 868,058, there is disclosed a somewhat cumbersome snorkel construction. It is suggested that the main part of the snorkel is made from glass. It includes an air tube having an upper flared end, and a short tube connecting the air tube to a mouthpiece and a water sack. The water sack is intended for the collection of sweat, saliva and other fluids, but is rigid and has to be inverted to be emptied. It is also stated that the end of the air pipe or tube must always be above water, and that it must be extended for deeper diving. It is thus not intended for use in the same way as a conventional snorkel, where one can submerge for periods allowing the snorkel to fill up with water while submerged.

Italian Pat. No. 401,363 addresses the problem of diving to depths where the length of the air pipe can result in a significant buffer zone of air that is continuously inhaled and exhaled. To this end, a through-flow air supply system is provided, including a small, floating air pump.

Italian Pat. No. 590,401 discloses a snorkel, in which provision is made for entry of unwanted water. For this purpose, at the bottom of the snorkel, two conduits are provided, one above the other. Consequently, if the lower conduit becomes blocked with water, a clear passage is still provided through the upper conduit. It is suggested that, with both passageways full of water, the user can exhale, to displace water from both passageways and the main air inlet tube. It seems questionable whether this would work. Also, in use, as the snorkel slowly fills up with small quantities of water, the user has to wait until both passageways are blocked with water, before attempting to expel the water. Until both passageways are blocked, the user or swimmer cannot generate sufficient back pressure to empty them. Consequently, one will at some stage have the situation where the lower passageway is filled, and the upper passageway is partly filled, but insufficiently filled to enable the user to expel the water. It is then highly likely that water will be accidentally entrained in inhaled air, leading to choking, coughing. Also, as the shipped water is retained in the lower passageway, which is in full communication with the upper passageway, it is quite likely that sudden movement of the swimmer will also cause water to be entrained in inhaled air.

It will thus be appreciated that, despite numerous attempts, there is currently no satisfactory solution to the problem of water accidentally entering a snorkel. Small quantities of water entrained into the inhaled air can cause choking, coughing, spluttering etc of the swimmer. At best, this is extremely inconvenient. In some circumstances it can be quite dangerous. Further, it is extremely distracting for the swimmer, to have to always be mentally alert for the possibility of water being drawn in when he inhales. Preferably, a snorkel should be such that the swimmer can be reasonably confident that he can breathe freely, without inhaling any water.

In known snorkel designs, as disclosed in the Shamlian U.S. Pat. No. 4,066,077, it is a relatively easy matter to expel a large quantity of water. Where there is sufficient water to completely block the snorkel, then the user or swimmer can generate sufficient back pressure, to expel this water as a plug. Problems arise, where there is a small quantity of water, insufficient to block the snorkel. If it is left in the snorkel, the swimmer is then subject to gurgling etc as he inhales, with the real possibility that some of this water might be inhaled. Expelling this small quantity of water is difficult. It can only be expelled by means of short, sharp exhalations, which effectively force the water out by viscous or like effects. Frequently, it requires a number of short, sharp breaths to clear such a small quantity of water, and inevitably not all of it is removed.

Accordingly, a snorkel should both prevent any accidentally shipped water reaching the user or swimmer, and also enable the swimmer to readily expel the water.

SUMMARY OF THE INVENTION

In accordance with the present invention, there is provided a snorkel for use by a swimmer, the snorkel comprising: a mouthpiece; a breathing tube connected to the which portion is lowermost in use; and a container, defining a chamber for fluid, which is in in communication only with said portion said communication allowing fluid flow in either direction and which is sufficiently rigid to prevent collapse of the container, in use, from surrounding water presure to enable fluid entering the snorkel accumulate in said chamber, to prevent passage to a user, and is sufficiently resilient to enable the container to be collapsed to expel accumulated fluid into said portion, to enable it to be expelled by exhalation.

The provision of the resilient container, simultaneously both enables fluid to be accumulated, and enables fluid to be expelled, without the necessity of the swimmer surfacing. Should any fluid, such as water or saliva, enter the snorkel, then, under the influence of gravity, it will naturally fall down into the container. Once in the container, it cannot be displaced, and should not interfere with the swimmer's breathing.

When the container is full enough, it can be compressed by the swimmer, to expel its contents into the lowermost portion of the snorkel. Then, by simply exhaling, the swimmer can expel most of this fluid. Preferably, the container is big enough, to accumulate enough fluid for closing off the lowermost portion of the snorkel. Then, this accumulated water can be expelled readily as a plug. However, for some uses, it may be satisfactory if the container can accumulate less water. Then, the swimmer should still be able to expel the bulk of it, by a sharp exhalation. In any event, if the swimmer does not expel all the water, and there will always be some water retained on the walls of the tube, then this water can be left to drain back into the container. When the container is released remaining fluid will be sucked into it. The snorkel is then free, and unobstructed by any water, for further use.

It is expected that a snorkel employing this construction should enable a swimmer to remain submerged for extended periods. It should be unnecessary for the swimmer to ever surface, for the purposes of emptying the snorkel of water, as is commonly done with known snorkels.

The snorkel of the present invention is conveniently moulded from plastic. It is conceivably moulded as one piece, or it can be moulded as two or more separate pieces, which are fitted together, in known manner.

BRIEF DESCRIPTION OF THE DRAWINGS

For a better understanding of the present invention, and to show more clearly how it may be carried into effect, reference will now be made, by way of example, to the accompanying drawings, in which.

DESCRIPTION OF THE PREFERRED EMBODIMENTS

Figure 1:
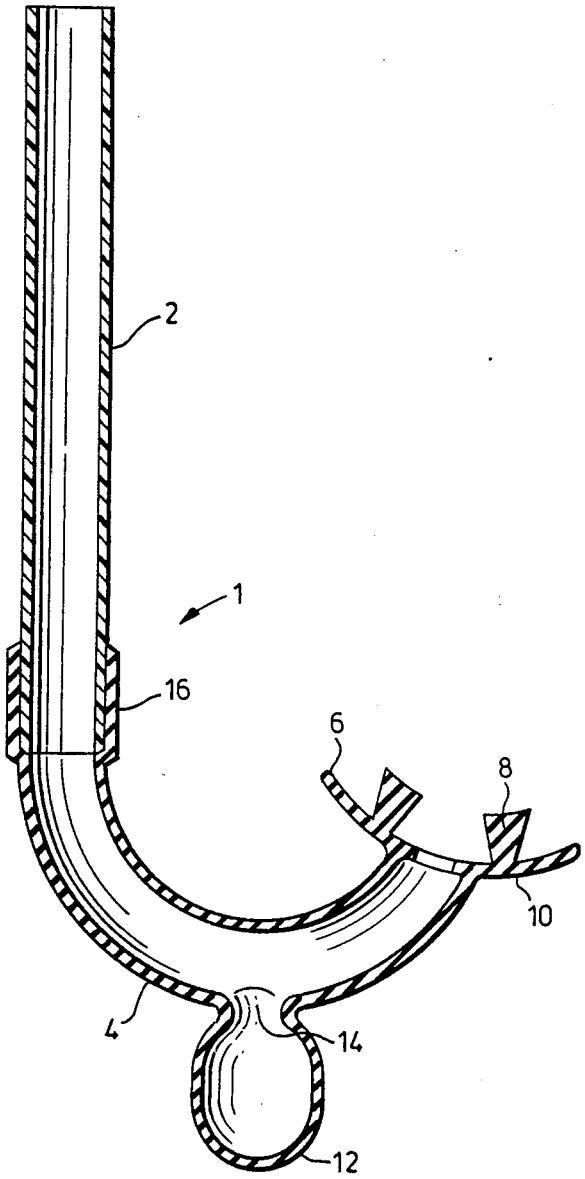
FIG. 1 shows a section through a first embodiment of a snorkel according to the present invention.

With reference to FIG. 1, there is shown a snorkel, generally denoted by the reference 1. The snorkel 1 includes a breathing tube 2, connected to a generally U-shape member 4. The interior of the U-shape member 4 provides a continuation of the breathing tube 2. The other end of the U-shape member 4 is provided with mouthpece 6.

In known manner, the mouth-piece 6 includes teeth grips 8 extending from a flange portion 10. In use, the teeth grips 8 are gripped by a swimmer's teeth, with the flange portion 10 located between the lips and gums of the swimmers mouth. This provides a good seal.

The components of the snorkel 1 described so far are largely conventional. In use, with the mouthpiece 6 gripped in the swimmer's mouth, the breathing tube 2 will extend alongside the swimmer's face. Thus, when the swimmer has his face down, the breathing tube will extend generally vertically. As a result, the swimmer can breathe easily through the tube 2, with his face below the water. Usually, the snorkel 1 is used in conjunction with a face mask (not shown), which enables the swimmer to see clearly underwater. In such a case, it is common for the breathing tube 2 to be provided with a small strap, to hold it to a strap of the face mask, so as to maintain the breathing tube 2 in the desired position.

However, the breathing tube 2 only extends a short way above the water's surface, and it is quite easy for water to enter it. This is particularly the case, when one is swimming on a large body of water, in poor conditions. If water enters the snorkel 1, it is difficult for the user to expel it. The water naturally collects at the bottom of the U-shape member 4, under the influence of gravity. When inhaling, it is possible for part of the water to be entrained in the enhaled air. This can cause considerable discomfort, with coughing etc. In certain circumstances, it could be quite dangerous. Where there is only a small quantity of water, it is difficult for the user or swimmer to expel it. It is only really easy to expel a large quantity of water, which is sufficient to completely close off the snorkel. In this case, the swimmer can generate sufficient pressure behind the water to expel it as a plug.

In accordance with the present invention, the snorkel is modified, to allow for the possibility of water entering the breathing tube 2. For this purpose, at the bottom of the U-shape member 4, there is provided a bulb or container 12. As described in detail below, the bulb or container 12 serves to collect water entering the snorkel 1, and to prevent water being entrained in inhaled air.

As shown by the hatching in the drawing, in this first embodiment, the U-shape member 4, the mouthpiece 6 and the bulb or container 12 are formed together. They are integrally moulded in one piece from plastic. Additionally, the U-shape member 4 is provided with a collar 16. The breathing tube 2 is a separate component, which is received in the collar 16. The breathing tube 2 could be simply cut from a length of plastic tube, and is preferably formed form relatively rigid material. The bulb or container 12 is resilient, and consequently the plastic used for it should be relatively soft. In order to ensure that the U-shape member 4 and mouthpiece 6 have the desired properties, they can, if necessary, be formed thicker than the bulb or container 12. This should ensure that the U-shape member 4 and the mouthpiece 6 are sufficiently rigid, whilst the bulb 12 has a required degree of resilience. As will become clear below, the container 12 should be sufficiently resilient to enable it to be compressed or collapsed manually, whilst being sufficiently stiff to prevent collapse under the pressures to which it is subjected in use by water.

In use, the snorkel 1 is fitted like a conventional snorkel. The mouthpiece 6 is gripped in the swimmer's mouth, and usually the breathing tube 2 will be attached or restrained to a strap of a mask or the like. Then, as before, the swimmer is free to inhale and exhale through the breathing tube 2 and U-shape member 4. However, if water is now splashed, into, or otherwise enters, the snorkel 1, it cannot collect at the bottom of the U-shape member 4. Instead, any such water will travel down the breathing tube 1, through the U-shape member 4, into the container 12. It should be noted that the container 12 is in the best position for collecting water entering the snorkel 1. As the water travels downwards, gravity and any centrifugal forces will naturally tend to urge it towards the opening 14 into the container 12. Consequently, it is expected that virtually no water will be carried up the right-hand side of the U-shape member 4 to the mouthpiece 6. Once water has entered the container 12, it will not be disturbed by inhalation or exhalation. Consequently, the swimmer should be able to inhale and exhale freely. Any water that enters the snorkel 1 during inhalation should be diverted into the container 12, and once in the container 12 will not interfere with breathing.

After a period of time, the container 12 will become so full that it cannot receive much more water. The swimmer can then compress the container 12, as by gripping it with his hand, to urge the contents out into the U-shape member 4. In this embodiment, the container 12 has a volume sufficient to hold enough water to close off the bottom of the U-shape member 4, when the contents of the container 12 are expelled into the U-shape member 4. In use therefore, the swimmer first inhales fully and then manually compresses the container 12, to expel its contents into the U-shape member 4 and close it off. The swimmer then exhales with some force, to cause the water in the bottom of the U-shape member 4 to be expelled out through the breathing tube 2. Since there is sufficient water to close off the breathing passage through the snorkel 1, this water can be expelled as a plug, and it is relatively easy for the swimmer to generate sufficient back pressure to expel it. It is possible that some water will be left in the snorkel 1, after this operation, as viscous and like effects will retain a film of water in the interior of the snorkel 1. In a conventional snorkel, this could be a problem, as one could be left with a small quantity of water at the bottom, which could later interfere with breathing. However, with the snorkel 1 of the present invention, any residual water left does not cause a problem. The swimmer simply releases the container 12 so that it expands to its shape shown. Then, any residual water in the snorkel 1, will simply drain down into the container 12, so as to leave the breathing passage through the snorkel 1 completely unobstructed.

If the swimmer wishes to dive below the surface of the water, then, in known manner he can simply take a large breath before diving. During the dive, the snorkel 1 will fill with water. Upon surfacing, he should simply grasp the container 12, to expel its contents. He should then expel forcebly as before, to expel the water from the snorkel 1. Again, the bulb 12 can then be released, to permit any residual water to drain into it.

It is thus expected that the snorkel of the present invention should be simple and offer advantages compared to known snorkels. A swimmer need not concern himself or worry about spray or small quantities of water entering the snorkel 1, which in known snorkels can cause considerable discomfort and inconvenience. Instead, he can concentrate on swimming or other activities. Small quantities of water are held in the container 12, clear of the breathing passage. When it is necessary to expel water, this can always be expelled in large quantities as a plug. This is relatively easy. In known snorkels, one frequently has the problem of trying to eliminate small quantities of water, and this frequently can only be achieved by surfacing and manually emptying the snorkel.

Figure 2:
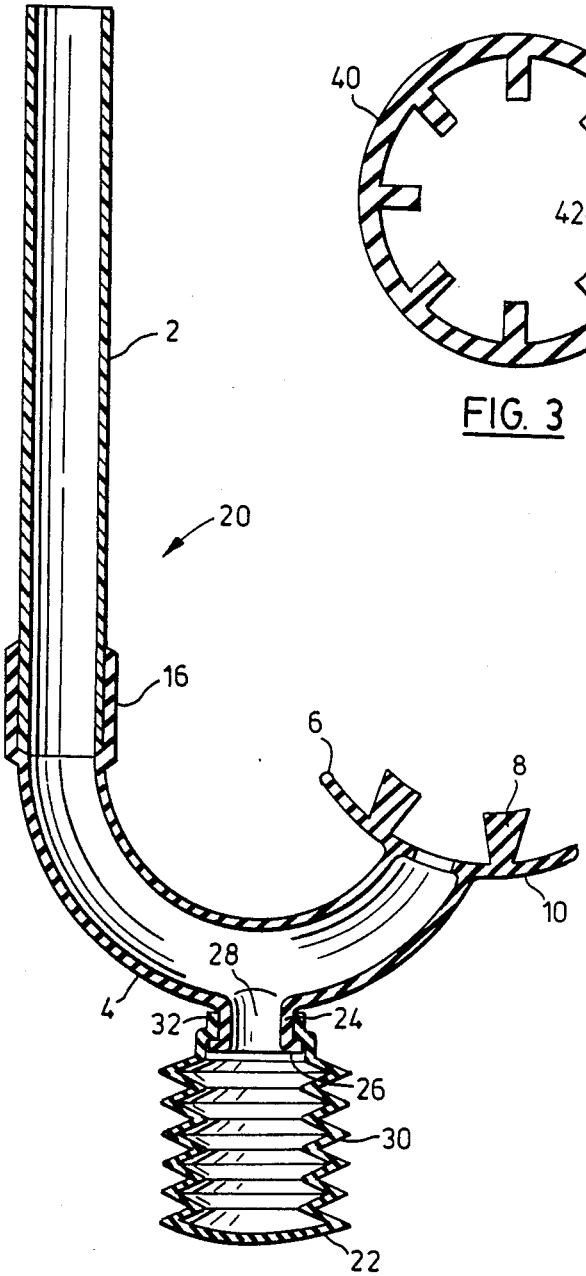
FIG. 2 shows a section through a second embodiment of a snorkel according to the present invention.

Reference will now be made to FIG. 2, which shows a second embodiment of the snorkel. Here, like parts are given the same references as in FIG. 1. The whole snorkel is here denoted by the reference 20.

In this second embodiment, the bulb or container is not integral with the U-shape member. Instead, a bulb or container 22 is provided, which is moulded as a separate component from the U-shape tube member 4. The U-shape member 4 is provided with a short downward extension 24, which at its lower end has an outwardly extending annular lip 26. The extension 24 defines a short, generally circular inlet 28. The container 22 is cylindrical and has concertina or corrugated side walls 30. At its upper end, the container 22 has a sealing portion 32, adapted to engage and be held by the annular lip 26.

Since the U-shape member 4 and the container 22 are formed separately, they can be made from different materials. In particular, the U-shape member 4 can be moulded in a relatively rigid plastic material, bearing in mind that the mouthpiece 6 should be slightly resilient, whilst the container 22 can be moulded from a more resilient material. The provision of the concertina or corrugated portion 30 facilitates collapse or compression of the container 22. In use, the container 22 would be gripped and collapsed as before.

Instead of the annular corrugations 30, the container 22 could be provided with axially extending corrugations.

Figure 3:
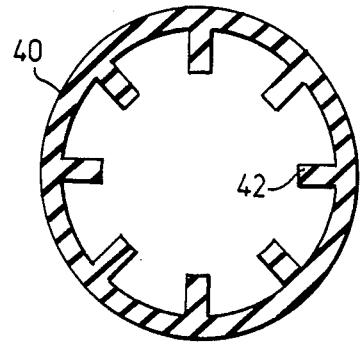
FIG. 3 shows a horizontal section through an alternative container construction.

Referring to FIG. 3, there is shown an alternative construction for the resilient container which is preferred to the corrugated construction. Here, the resilient container is denoted by the reference 40, and includes a plurality of internal ribs 42. Here there are eight ribs, although the number could be varied. The ribs 42 extend radially, to the full height of the container 40. In use, the ribs 42 keep the container 40 stiff. However, when it is collapsed, the ribs 42 buckle so as to offer little resistance to complete collapse of the container 40.

It is to be appreciated that there are many variations, possible within the broad concept of the present invention.

It is expected that the snorkel of the present invention will be conveniently manufactured by moulding in plastic. In such a case, the usual requirements for moulding might necessitate small changes in the design, to enable the various components to be readily formed and released from a mould Thus, for example, the snorkel could be formed in a variety of different ways. Whilst FIG. 1 shows a two-part snorkel and FIG. 3 shows a three-part snorkel, other constructions are possible. The snorkel could be formed as one single piece by moulding, alternatively the mouthpiece 6 for example could be formed separately from the rest of the snorkel.

Also, there are a number of possibilities for the shape and configuration of the bulb or container 12, 22. It is preferable that it has a volume sufficient to enable it to close of the U-shape member 4 with water, but for some purposes it may be sufficient for the container 12, 22 to have a lesser volume. The container shapes shown are intended for being gripped by themselves. However, it is possible for the container to be relatively flat and close to the U-shape member 4. Then, the swimmer could grip the U-shape member 4 and the container, and compress the container against the bottom of the U-shape member 4.

The shape of the opening 14 into the container can be varied. It should be large enough to catch water passing down into the snorkel, whilst being small enough to prevent water being accidentally displaced out of the container into the breathing passage. It may prove desirable to have relatively large opening which promotes downward movement of water. In any event, the opening should be sized so as to prevent water being entrained in inhaled air, whilst collecting fluid in the snorkel.

I claim:

1. A snorkel, for use by a swimmer, the snorkel comprising: a mouthpiece; a breathing tube connected to the mouthpiece and including a portion adjacent the mouthpiece, which portion is lowermost in use; and a container defining a chamber for fluid, which is in communication only with said portion, said communication allowing fluid flow in either direction and which container is both sufficiently rigid to prevent collapse of the container, in use, from surrounding water pressure while enabling fluid entering the snorkel to accumulate in said chamber to prevent passage of fluid to a user, and which is sufficiently resilient to enable the container to be collapsed to expel accumulated fluid into said portion, to enable such accumulated fluid to be expelled by exhalation.

2. A snorkel as claimed in claim 1, which includes a hollow U-shape member, which extends between one end of the breathing tube and the mouthpiece, with said portion of the breathing tube being provided at a lowermost, central section of the U-shape member.

3. A snorkel as claimed in claim 2, wherein the container is connected to the U-shape member and is in direct communication with a lowermost, central section of the U-shape member.

4. A snorkel as claimed in claim 3, which comprises as separate components: the breathing tube; the U-shape member and the mouthpiece integral therewith, the U-shape member including a sleeve at its end remote from the mouthpiece for connection to the breathing tube; and the container which is connected to the U-shape member.

5. A snorkel as claimed in claim 4, wherein the U-shape member includes an extension having an outwardly extending annular lip, to which extension the container is connected.

6. A snorkel as claimed in claim 4 or 5, wherein the breathing tube and the U-shape member are each moulded from a relatively stiff plastic material, and wherein the container is moulded from the relatively resilient plastic material.

7. A snorkel as claimed in claim 3 which comprises as separate components: the breathing tube; and the U-shape member, the mouthpiece and the container integrally formed together.

8. A snorkel as claimed in claim 7, wherein the breathing tube is formed from a relatively stiff plastic material, and wherein the U-shape member, the mouthpiece and the container are formed from a more resilient material, with the container having thinner walls to enable it to be readily collapsed.

9. A snorkel as claimed in claim 1, 4 or 7, wherein the container includes a concertina section, to facilitate collapse of the container.

10. A snorkel as claimed in claim 1, 4, or 7 wherein the container includes internal stiffening ribs.

11. A container as claimed in claim 1, 4 or 7, wherein the container has a volume sufficient to enable a quantity of water to be expelled from the container, which is large enough to close off the snorkel, whereby that water can be expelled as a plug by exhalation.

12. A valveless snorkel, for use by a swimmer, the snorkel comprising: a mouthpiece; a breathing tube connected to the mouthpiece and including a portion adjacent the mouthpiece, which portion is lowermost in use; and a chamber means, which is in communication only with said portion, said communication allowing fluid flow in either direction, and which is both sufficiently rigid to prevent collapse of the container, in use, from surrounding water pressure while enabling fluid entering the snorkel to accumulate in said chamber means to prevent passage of fluid to a user, and is collapsible by the user, to enable accumulated fluid to be expelled into said portion, so that such accumulated fluid can be expelled by exhalation.

13. A valveless snorkel, for use by a swimmer, the snorkel comprising: a mouthpiece; a breathing tube connected to the mouthpiece and including a portion adjacent the mouthpiece, which portion is lowermost in use; and a container defining a chamber for a fluid, which is in communication only with said portion, said communication allowing fluid flow in either direction and which has a volume generally equal to the volume of liquid necessary to close off the snorkel, the container being both sufficiently rigid to prevent collapse of the container, in use, from surrounding water pressure while enabling fluid entering the snorkel to accumulate in said chamber to prevent passage of fluid to a user, and being sufficiently resilient to enable the container to be collapsed to expel accumulated fluid into said portion, to enable such accumulated fluid to be expelled as a plug by exhalation.

* * * * *